United States Patent [19]

Diefendahl et al.

[11] Patent Number: 4,730,574

[45] Date of Patent: Mar. 15, 1988

[54] COLLAPSIBLE PONTOON

[75] Inventors: Wolfgang Diefendahl, Straelen; Carsten Schmitz, Remscheid, both of Fed. Rep. of Germany

[73] Assignee: Fried. Krupp Gesellschaft mit beschränkter Haftung, Essen, Fed. Rep. of Germany

[21] Appl. No.: 843,553

[22] Filed: Mar. 25, 1986

[30] Foreign Application Priority Data

Mar. 25, 1985 [DE] Fed. Rep. of Germany ..... 3510778

[51] Int. Cl.[4] ..... B63B 7/00

[52] U.S. Cl. ..... 114/354; 14/27

[58] Field of Search ..... 114/343, 355, 352–354, 114/364, 361, 77 R, 77 A, 292; 405/219–221; 14/2.6, 27

[56] References Cited

U.S. PATENT DOCUMENTS 4,355,431 10/1982 Diefendahl et al. ..... 14/27

4,386,441 6/1983 Lundholm ..... 405/220

FOREIGN PATENT DOCUMENTS 229746 10/1963 Austria .

1966374 4/1974 Fed. Rep. of Germany .

2941374 4/1981 Fed. Rep. of Germany .

3004397 7/1982 Fed. Rep. of Germany .

391219 12/1973 U.S.S.R. ..... 14/27

*Primary Examiner*—Galen Barefoot

*Assistant Examiner*—Jesûs D. Sotelo

*Attorney, Agent, or Firm*—Spencer & Frank

[57] ABSTRACT

A pontoon includes a plurality of side-by-side arranged buoyant bodies articulated to one another to allow the pontoon to be placed in a collapsed or in an extended state. Each flanking buoyant body has a bottom face sloping upwardly in an outwardly direction, a top face and a wall element arranged at an outer portion of the flanking buoyant body. The wall element has a position in which it slopes upwardly and projects beyond the top face in an upward direction.

14 Claims, 11 Drawing Figures

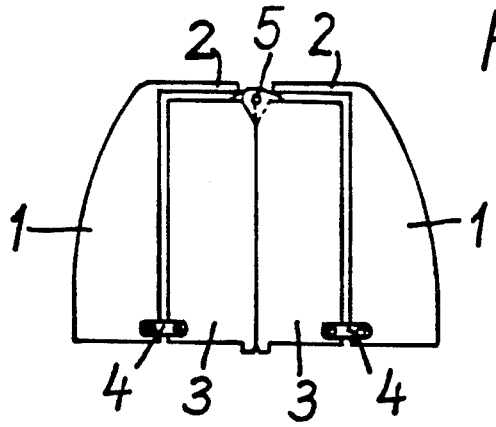
FIG. 1
FIG. 2
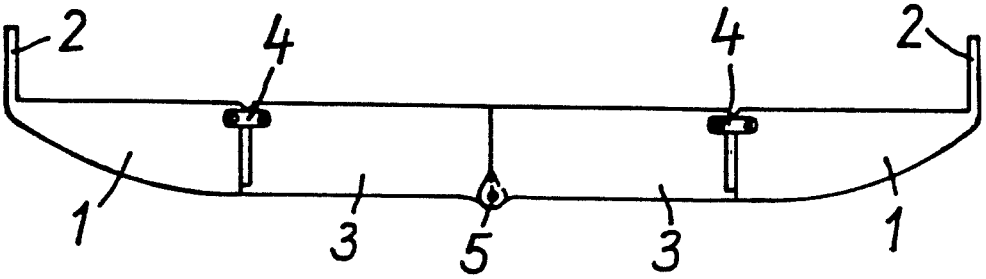
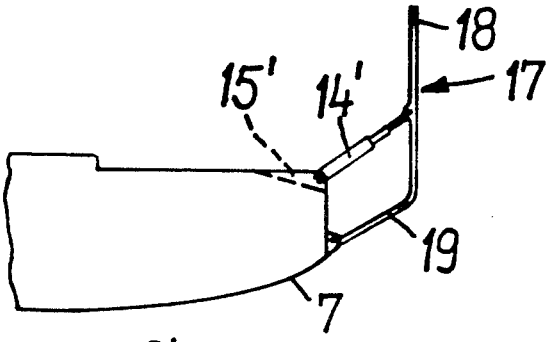
FIG. 8
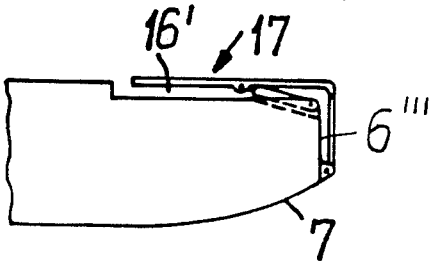
FIG. 9

COLLAPSIBLE PONTOON

BACKGROUND OF THE INVENTION

This invention relates to a pontoon formed of a plurality of jointedly interconnected buoyant bodies which may be brought into a collapsed state and which may be locked in position (immobilized) relative to one another. The pontoons are adapted to be serially connected to one another to form a pontoon bridge for pedestrian and/or vehicular traffic. The two flanking buoyant bodies have a bottom which slopes upwardly towards the outside. Known pontoons of the above-outlined type are generally formed of four buoyant bodies which, from their extended position, may be collapsible into either a "W" or an "M" configuration. It is a disadvantage of these known pontoons that in various operational conditions, particularly under heavy loads, their buoyant stability is adversely affected.

SUMMARY OF THE INVENTION

It is an object of the invention to provide an improved pontoon of the above-outlined type whose load capacity is increased without increasing the maximum shipping dimensions in the collapsed state.

This object and others to become apparent as the specification progresses, are accomplished by the invention, according to which, briefly stated, at the opposing outer sides of the pontoon an additional upstanding (upwardly oriented) wall element is provided.

The pontoon according to the invention has several advantages: the increased buoyancy of the pontoon permits greater loads or has a lower water line in case of identical loads which is a particular advantage in shallow waters. Further, the water will be prevented from washing over the travelling surface. The widening of the pontoon structure increases the safety of the pontoon bridge users, particularly pedestrians.

The invention may find application in any type of collapsible pontoons which, in addition to an "M" or "W" configuration, may also be of the "U"-shaped collapsible type.

The pivotal mobility of the wall elements results in a great variety of configurational possibilities. The wall elements may serve as a splash wall, as a boundary for vehicular traffic, as a bridge barrier (railing) or as a pontoon widening element. They may have a plurality of these functions simultaneously or in the alternative.

Particularly in case the wall element according to the invention is vertically oriented, there is achieved a protection of vehicles from falling overboard, and a great degree of stability may be achieved in a simple manner by using a stationary, that is, non-pivotal wall element. To increase the safety in darkness or under conditions of poor visibility, the wall elements may be provided with inwardly oriented reflectors.

By the advantageous positioning of the articulations within the profile of the buoyant body, the construction will have no projecting parts in the collapsed state.

According to a further feature of the invention, the two flanking buoyant bodies are, at least in their outer zone, that is, where they are not exposed to vehicle loads, formed as foam-filled solid bodies and thus may have thin walls, resulting in a greater load capacity of the pontoon, particularly if combined with an omission of the travel surface plates.

A further widening of the effective width of the pontoon bridge is achieved according to a further feature of the invention in that the prolonged part of the buoyant bodies may be covered by a web which may serve particularly as a foot plank.

According to a further feature of the invention, the wall elements may be arranged also on the wedge-shaped ramp pontoon in the length dimension of the bridge and may be divided in the length dimension of the bridge in case such a solution is expedient. Aluminum alloys are primarily considered as materials for the pontoon.

BRIEF DESCRIPTION OF THE DRAWING

FIGS. 1 and 2 are schematic side elevational views of a first preferred embodiment of the invention shown in the cellapsed and in the extended state, respectively.

FIGS. 8 and 9 are schematic side elevational views of a further preferred embodiment of the invention, illustrated in an outwardly-pivoted and in an inwardly-pivoted state, respectively.

DESCRIPTION OF THE PREFERRED EMBODIMENTS

Figure 3:
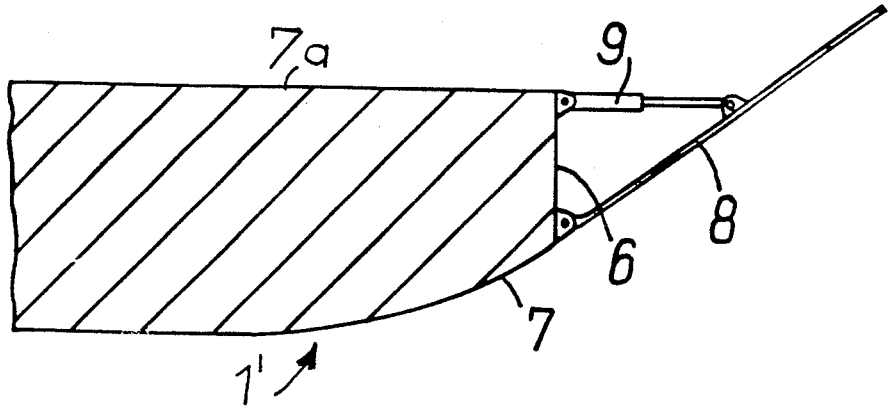
FIGS. 3 and 4 are schematic side elevational views of another preferred embodiment of the invention shown in an outwardly-pivoted and in an inwardly-pivoted state, respectively.

Turning now to FIGS. 1 and 2, there is illustrated therein a pontoon which is collapsible in a W-configuration and whose outer (flanking) buoyant bodies 1 each carry, fixedly attached thereto, a plate-shaped wall element 2 which, in the extended (opened) state of the pontoon is oriented upwardly as illustrated in FIG. 2. In the collapsed state, the wall elements 2 extend over the two inner buoyant bodies 3 so that in the shipping state the profile of the pontoon is not enlarged and the permissible dimensions for the shipping profile are not exceeded.

The coupling of the outer and inner buoyant bodies 1 and 3 is effected by a dual articulation 4 by means of which, as shown in FIG. 2, the pontoon may be brought into a position in which it has an entirely planar upper surface utilizable in its entire width. The underside of the pontoon too, is entirely flat and thus has a flow-dynamically advantageous configuration. The lower wall faces of the outer buoyant bodies 1 curve upwardly towards the outside which also enhances flow-dynamic characteristics. The buoyant bodies 3 are connnected with one another at the underside by a simple joint 5.

Figure 4:
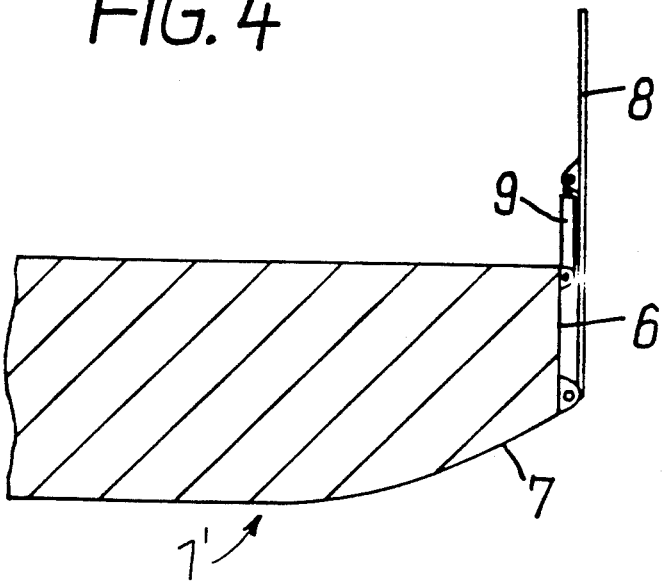

Turning now to the embodiment illustrated in FIGS. 3 and 4, there is shown an outer (flanking) buoyant body 1' in the extended (opened) position. The body 1' has at its outside a vertical outer wall face 6. To the corner of the body 1' formed by the wall face 6 and the rising underside 7 there is articulated a one-piece wall element 8 which in the outwardly-pivoted position (FIG. 3) prolongs the underside 7 to such an extent that the outer edge thereof extends beyond the top face **7*a* of the buoyant body 1'. Two hydraulic cylinders 9 (only one shown) are, at one end, articulated to the wall element 8, approximately in the middle of its lateral length. The other ends of the hydraulic cylinders 9 are articulated to the upper corner of the buoyant body 1' where the top face 7a and the outer wall face 6 intersect. In the inwardly-pivoted state of the wall element 8, as shown in FIG. 4, the hydraulic cylinders 9 have moved the wall element 8 into a position in which it assumes an orientation similar to that of the rigid wall element 2 of the embodiment illustrated in FIGS. 1 and 2**.

Figure 5:
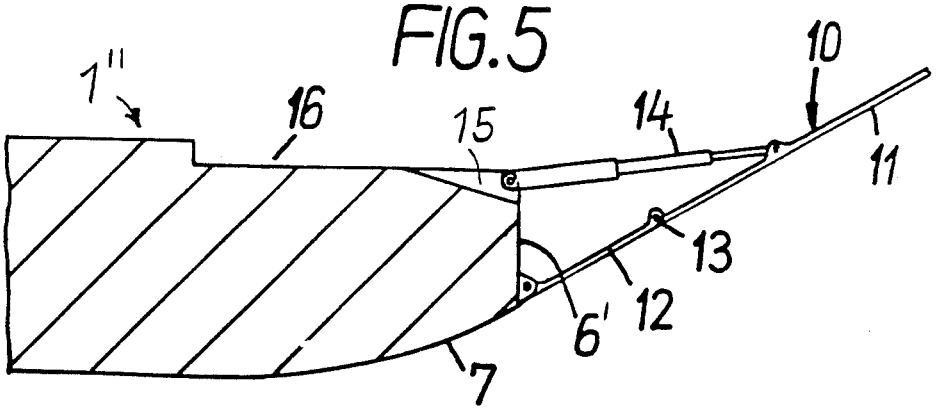
FIGS. 5, 6 and 7 are schematic side elevational views of still another preferred embodiment of the invention, illustrated in three different positions, respectively.
Figure 7:
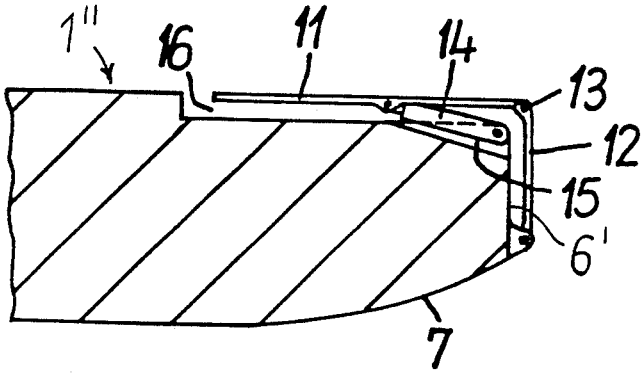
Figure 6:
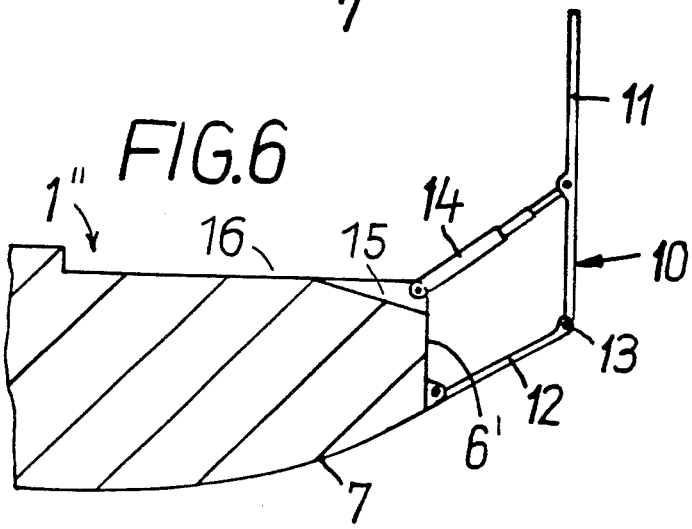

Turning now to the embodiment illustrated in FIGS. 5, 6 and 7, the illustrated outer buoyant body 1" is of a configuration similar to that shown for the embodiment of FIGS. 3 and 4. The difference resides essentially in that at the corner formed between the rising underside 7 and the vertical wall 6' the jointed wall element 10 is a two-part construction formed of components 11 and 12 connected to one another by a joint 13. The outer part 11 of the wall element 10 is jointed to two parallel hydraulic cylinders 14 (only one shown) which are secured at their other ends to the upper corner of the outer buoyant body 1" with their pivotal axes in alignment with one another. The pivotal axes of all articulations of the wall element 10 and the pontoon are parallel to one another. In the outwardly-pivoted state of the wall element 10, as shown in FIG. 5, the underside 7 of the buoyant body 1" is extended upwardly. FIG. 7 shows the entirely inwardly-pivoted state of the wall element 10, whereby the outer part 11 and the inner part 12 form a rectangle at the articulation 13 and the closed hydraulic cylinders 14 are withdrawn into a recess or niche 15 at the upper corner of the buoyant body. The top face of the buoyant body further has a flat recess 16 which receives the outer part 11 of the wall element 10 in the fully inwardly-pivoted position so that the latter does not project beyond the outline of the buoyant body 1". In this manner, the top faces of the buoyant bodies of the collapsed pontoon—if being collapsible in a W-configuration—lie on one another. FIG. 6 shows a mid-position of the wall element 10 between its fully opened (FIG. 5) and the fully inwardly-pivoted position (FIG. 6). In the FIG. 6 position the outer part 11 of the wall element 10 projects vertically upwardly. This position may be assumed, for example, for increasing the protection against flooding in case of large waves.

Turning now to the embodiment illustrated in FIGS. 8 and 9, the latter differs from that shown in FIGS. 5, 6 and 7 essentially in that the wall element 17 is a one-piece component and is angled in such a manner that its outer part 18 is, in the outwardly-pivoted position (FIG. 8) oriented vertically upwardly and its inner part 19 extends the underside 7 of the buoyant body obliquely upwardly. There are provided two hydraulic cylinders 14' (only one shown) attached to the outer part 18 of the wall element 17 and to the upper corner of the buoyant body, within a recess or niche 15'. The upper face of the buoyant body has a shallow recess 16' onto which the wall element 17 may be pivoted. The outer wall 6''' of the buoyant body conforms to the angle of the wall element 17.

Figure 10:
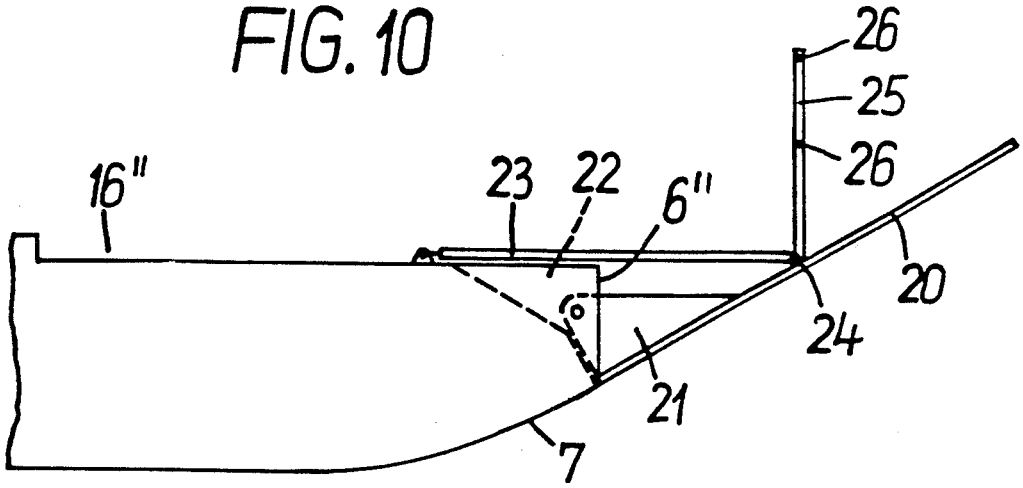
FIGS. 10 and 11 are schematic side elevational views of still another preferred embodiment of the invention illustrated in the outwardly-pivoted and inwardly-pivoted state, respectively.
Figure 11:
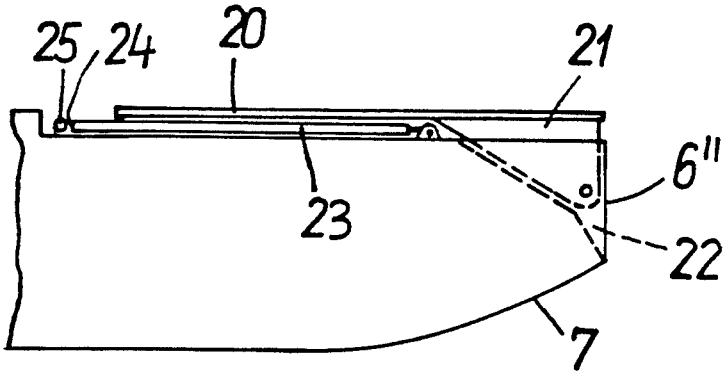

In the embodiment illustrated in FIGS. 10 and 11 there is provided a single-piece wall element 20 which has a plurality of pivot eyelet plates 21 (only one shown) which are in axial alignment and which are mounted in a niche 22 at the outer side of the buoyant body. In the outwardly-pivoted condition the pivot-side end of the wall element 20 engages the outer corner of the vertical outer wall 6" of the buoyant body. In the inwardly-pivoted state the wall element 20 is received in a shallow recess 16" on the upper face of the buoyant body. The part of the buoyant body which is extended by the outwardly-pivoted wall element 20 is covered by a plate-like web 23 in such a manner that the upper side of the buoyant body is linearly extended outwardly. The web 23 is pivoted to the shallow recess 16" of the upper face of the buoyant body and engages at its other end 24 the wall element 20, in the outwardly-pivoted state. Rail posts 25 are articulated to the end 24 of the web 23 for pivotal motion in the length direction of the pontoon bridge. The tops of the rail posts 25 are connected with cables 26 to one another. The inwardly-pivoted position of the web 23 and the rail posts 25 is illustrated in FIG. 11. The web 23 is, in this position, situated between the top face of the shallow recess 16" of the buoyant body and the wall element 20.

The movement of the wall elements into or out of their fully inwardly-pivoted position is effected by the respective cylinders simultaneously (and preferably automatically) with the closing (collapsing) or, respectively, opening (extending) of the buoyant body. The same applies for the locking arrangements.

The pontoon constructed according to the invention needs no special shipping vehicles, particularly by virtue of its flat outer surfaces in the folded (collapsed) position, as shown in FIG. 1. A removal from the transport vehicle may be effected in a simple manner on rollers mounted on the bed of a truck.

It will be understood that the above description of the present invention is susceptible to various modifications, changes and adaptations, and the same are intended to be comprehended within the meaning and range of equivalents of the appended claims.

What is claimed is:

1. In a pontoon including a plurality of side-by-side arranged buoyant bodies articulated to one another to allow the pontoon to be placed in a collapsed or in an extended state; external buoyant bodies on either side of the pontoon being flanking bodies; each said flanking body having a bottom face sloping upwardly in an outward direction and a top face; each said flanking body having an outer portion; further wherein each buoyant body of said pontoon has a top face and said pontoon is collapsible in a W-configuration; the improvement wherein said flanking body has a plate-shaped wall element arranged at said outer portion and extending away from the end thereof; said plate-shaped wall element having a position in which it slopes upwardly and projects to a substantial extent beyond said top face of said flanking body in an upward direction; in the extended state of the pontoon the top faces lying in a plane situated at a level below parts of said plate-shaped wall element in the upwardly sloping position thereof.

2. A pontoon as defined in claim 1, wherein each buoyant body of said pontoon has a bottom face; in the extended state of the pontoon the bottom faces have, when viewed in cross section, a continuous contour line.

3. A pontoon as defined in claim 1, wherein each said flanking body has an outer zone; said flanking bodies are solid, foam plastic parts at least in said outer zones thereof.

4. A pontoon as defined in claim 1, wherein said wall element is rigidly affixed to said outer portion.

5. A pontoon as defined in claim 4, wherein said wall element projects vertically upwardly.

6. In a pontoon including a plurality of side-by-side arranged buoyant bodies articulated to one another to allow the pontoon to be placed in a collapsed or in an extended state; external buoyant bodies on either side of the pontoon being flanking bodies; each said flanking body having a bottom face sloping upwardly in an outward direction and a top face; each said flanking body having an outer portion; the improvement wherein said flanking body has a wall element arranged at said outer portion; said wall element having a position in which it slopes upwardly and projects to a substantial extent beyond said top face in an upward direction; the improvement further comprising pivot means for articulating said wall element to said outer portion; said wall element having a inwardly-pivoted position and an outwardly-pivoted position.

7. A pontoon as defined in claim 6, wherein each buoyant body of said pontoon has a top face; said pontoon being collapsible in a W-configuration; in the extended state of the pontoon the top faces lie in a plane situated at a level below parts of said wall element in the upwardly sloping position thereof.

8. A pontoon as defined in claim 6, wherein said pontoon is collapsible in a W-configuration; in said inwardly-pivoted position said wall element being situated between two adjoining said buoyant bodies of said pontoon in the collapsed state thereof.

9. A pontoon as defined in claim 6, wherein said flanking body has a cross-sectional outline; said pivot means being situated within said cross-sectional outline.

10. A pontoon as defined in claim 6, wherein said wall element comprises consecutive first and second length portions interconnected by an additional pivot means.

11. A pontoon as defined in claim 10, wherein said flanking body has an upper corner, said additional pivot means being situated at said upper corner in the inwardly-pivoted position of said wall element.

12. A pontoon as defined in claim 6, wherein said wall element is, in said outwardly-pivoted position, an obliquely upwardly and outwardly oriented continuation of said bottom face.

13. A pontoon as defined in claim 12, further comprising a web covering at least one part of the wall element in the outwardly-pivoted position thereof.

14. A pontoon as defined in claim 13, said web being pivotally supported on said flanking body and having inwardly-pivoted and outwardly-pivoted positions; said web covering said wall element in the outwardly-pivoted position of said web.

* * * * *